US006736293B2

(12) United States Patent
Greiner-Perth

(10) Patent No.: US 6,736,293 B2
(45) Date of Patent: May 18, 2004

(54) MEDIA DISPENSER

(75) Inventor: Juergen Greiner-Perth, Gottmadingen (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 76 days.

(21) Appl. No.: 10/014,042

(22) Filed: Dec. 11, 2001

(65) Prior Publication Data

US 2002/0074360 A1 Jun. 20, 2002

(51) Int. Cl.[7] ..... B65D 88/54

(52) U.S. Cl. ..... 222/321.9; 222/383.3; 222/528

(58) Field of Search ..... 222/321.8, 321.9, 222/528, 383.3, 536

(56) References Cited

U.S. PATENT DOCUMENTS 3,116,856 A * 1/1964 Prussin et al. ..... 222/402.24
3,907,174 A * 9/1975 Steiman ..... 222/383.2
5,505,194 A 4/1996 Adjei et al.
5,988,434 A * 11/1999 Keil et al. ..... 222/536
6,557,736 B1 * 5/2003 Ophardt ..... 222/321.9

FOREIGN PATENT DOCUMENTS

DE 3911985 4/1989

* cited by examiner

*Primary Examiner*—Philippe Derakshani
(74) *Attorney, Agent, or Firm*—Quarles & Brady LLP

(57) ABSTRACT

The discharge head of the dispenser (1) comprises a supporting body (9) and a head body (3) pivotable relative to the latter by a pliant connection (40), namely an elastomeric passage section (47), including the delivery orifice (53). The bending of the passage section (47) is guided by a single-axis joint (50) and due to the pivoting movement an actuating finger rest (55) becomes accessible for manually actuating a discharge stroke of a pump (20).

8 Claims, 2 Drawing Sheets

Figures 1, 2, 3:
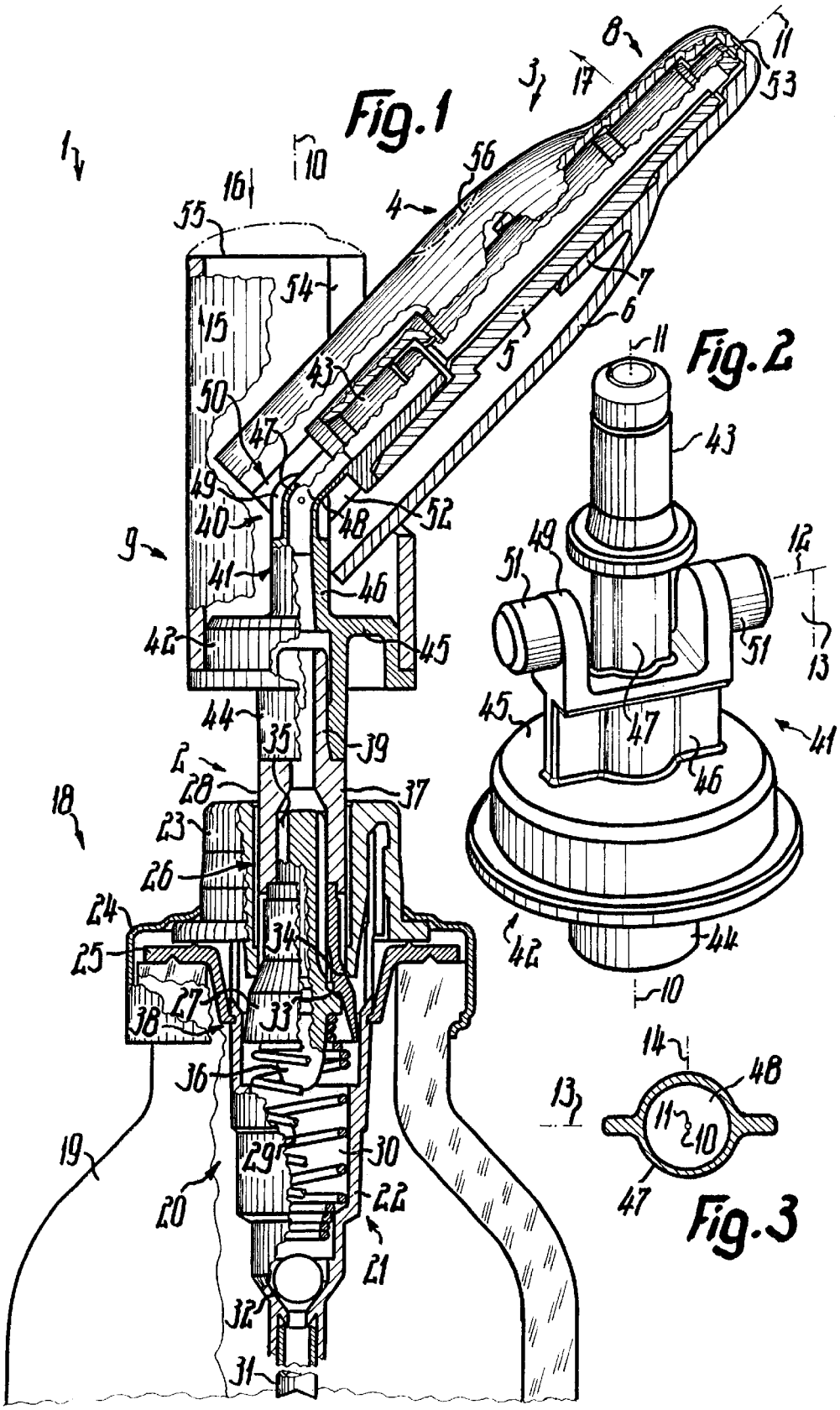

1
59
8
53
3
55
6
54
9
16
42
23
24
61
18
19
58
60
57
53

55
3
8
54
4
9
42
41
44

MEDIA DISPENSER

BACKGROUND OF THE INVENTION

The invention relates to a dispenser for media which may be liquid, pasty, powdery and/or gaseous. Hollow or shell-shaped or all components of the dispenser may be made of plastics or injection-molded. The dispenser is intended to be held and simultaneously actuated for discharge single-handedly so that pharmaceutical, cosmetic, technical or other media can be simply applied.

OBJECT OF THE INVENTION

Object of the invention is to provide a dispenser which avoids the drawbacks of known configurations and which more particularly permits changes in location between two basic bodies for adapting to individual requirements. According to another object of the invention, each location as set is required to be captive and expediently thereafter reversible. The means for changing locations are also intended for being retrofitted to existing dispensers. The dispenser is intended to be simple in configuration, safe in operation and convenient to handle.

SUMMARY OF THE INVENTION

The dispenser comprises two basic bodies which are separate parts or integral. Furthermore, the dispenser comprises a pliant portion, e.g. a joint which connects the basic bodies and which may be configured integral with one or both basic bodies or which may be a separate component. Furthermore, a cavity or passage is provided passing through at least one of the basic bodies or the pliant connection and which may be a cavity or passage having no throughflow in dispenser operation, through which a fluid such as the medium flows.

In accordance with the invention means are provided by which movements of the second basic body relative to the first basic body deform, e.g. curve or angle the cavity in the region of the pliant connection. This enables changes in the cross-section of the cavity to be achieved in altering corresponding properties of the dispenser.

The movements may be torsional or bending movements which alter the cross-sections of the cavity to a length which is maximally as large as 3 or 2 times the width of the cavity. The latter may thus change its cross-section in the jointing portion thereby, namely not only the cross-section shape but also the cross-section surface area of the passage within tight limits.

Expediently during discharge of the medium a finger-rest is accessible with which the basic bodies can be shifted relative to each other at any time in thereby deforming the pliant connection. Although the latter could be located partly or totally within a medium pump or a reservoir, it is expediently provided outside thereof in the region of a head which serves manual actuation of the pump or for discharging the medium through a delivery orifice. This enables the delivery orifice or its axis to be changed in location relative to the basic body or body of the pump without implementing a discharge stroke.

Although cross-sectionally the passage may be circular, it preferably deviates therefrom, e.g. by the cross-section becoming oblate, such as oval. The narrower sides of the cross-section are thereby penetrated by the axis of the joint and may be defined by wall sections comprising a thickness which is different, e.g. smaller, than that of the wall sections which define the longitudinal sides of the cross-section.

The pliant connection is expediently guided by a separate guide such as a joint or other sliding guide in thus precisely, e.g. positively, defining the pliant connection and not being solely dependent on the inherent mechanical response of the connection. The members of the joint may be radially spaced away from the cavity or passage section so that gaps are formed in between and the passage section may be curved like the free section of a flexible tube.

In a further embodiment of the invention the pliant passage section is shorter by 7 or 5 times its largest width so that little space is taken up. Adjoining the ends of this section are dimensionally rigid sections suitable for connecting adjoining parts of the dispenser, e.g. forming nipple-type connectors.

Although the pliant connection is suitable for a riser via which the medium flows from a reservoir into a pump or valve body, it is more particularly particularly suitable for being arranged outside of the body or reservoir.

These and further features read not only from the claims but also from the description and the drawings, it being understood that each of the individual features may be achieved by itself or in combination in the form of sub-assemblies in an embodiment of the invention or in other fields and may represent advantageous aspects as well as aspects worthy of being protected in their own right and for which protection is claimed herein.

BRIEF DESCRIPTION OF TIE DRAWINGS

Figure 4:
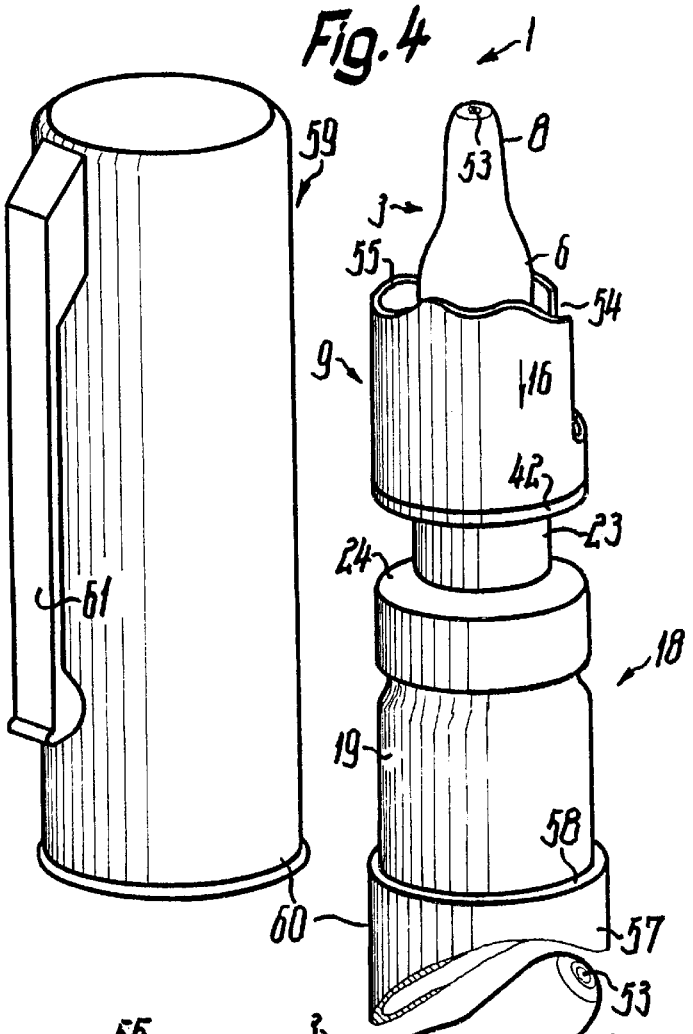
Figure 5:
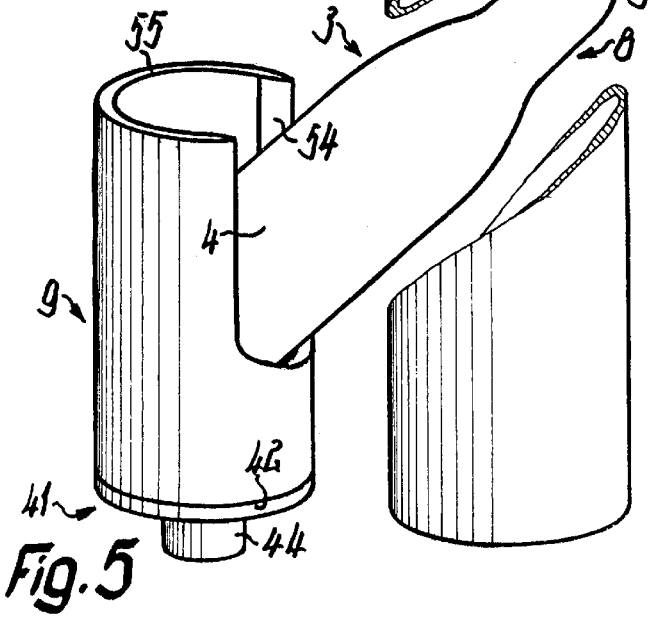

Example embodiments of the invention will now be detained as evident from the drawings in which:

FIG. 1 is a partly sectioned view of a dispensers in accordance with the invention, FIG. 2 is a view in perspective on a magnified scale of the guide body as shown in FIG. 1, FIG. 3 is a cross-section through the passage section of the pliant connection, FIG. 4 is a view in perspective of a further embodiment of a dispenser and FIG. 5 is a view in perspective of the discharge head as shown in FIG. 1.

DESCRIPTION OF A PREFERRED EMBODIMENT

Referring now to FIG. 1 there is illustrated how the dispenser 1 comprises a first and a second basic body, namely a connecting body 2 and a head body 3 of a discharge head. The latter serves both for discharging the media into the atmosphere as well as for actuating the dispenser by a rotary or linear movement. The head body 3 has an elongated head housing 4 including an exposed outer shell 6 and a substantially shorter inner shell 7. The shells 6, 7 translate into a common shell of a nozzle 8 suitable for insertion in a bodily opening, e.g. a nostril, and from the delivery orifice of which the medium emerges. The head housing 4 is movably mounted on a hollow supporting body 9 which forms a finger-rest for actuating discharge of the medium and surrounds the head housing 4 at its lower end in each position.

The supporting body 9 is permanently located in an axis 10 of the remaining parts of the dispensers located thereunder. The head body defines an axis 11 in line with the axis 10 and which can be moved from this position only in one direction relative to the axis 10, e.g. inclined up to the other end position through maximally 50° or 60° to the axis 10 continously about the axis 12. The axis 11 intersects the axis 10 and in the same point of intersection the axes 10, 11 are also intersected at right angles by the axis 12. When oriented coaxially the axes 10 to 12 form a common axial plane 13 to which a common axial plane 14 of the axes 10, 11 is located at right angles. In coaxial orientation of the axes 10, 11 the medium flows in the direction of the arrow 15 up to the delivery orifice. In the opposite direction 16 the discharge head needs to be moved manual relative to the basic unit 18 for implementing a discharge stroke, after which the discharge head is automatically returned to its starting position as shown in FIG. 1. The directions 15, 16 are located parallel to the axis 10 and the head body 3 can be pivoted in the direction 17.

The basic unit comprises a support, such as a reservoir 19, and a pump 20, such as a plunger pump, which primes medium in single doses from the reservoir 19 on the return stroke and delivers it on the subsequent pumping stroke through the head body 3 to the delivery orifice. The pump 20 comprises a pump body 21 which is rigidly secured to the reservoir 19. The body 21 consists of a longish body part 22 located mostly within the reservoir 19 and which is closed off outside of the reservoir 19 by a body part such as a cover 23. Instead of being configured separate, the cover 23 may also be configured integrally with the body part 22. The cover 23 non-releasably connected to the body part 22 by a snap-action connector comprises a flange having the shape of a flat ring and protruding radially outwards. This flange is secured by a fastener 24, such as a crimp ring, threaded cap or a snap-action cover to the reservoir 19 so that it is tensioned against the face of the neck of the reservoir 19 with a seal 25 interposed. The fastener 24 too, may be configured integrally with the body part 22 or cover 23. The outer and the inner width of the body part 22 is incrementally reduced in the direction 16 up to the end of the body.

Reversibly shiftably located in the body 21 is an actuator or piston unit 26 comprising a piston 27 and a piston shank 28. The piston shank 28 penetrates the cover 23 in the direction 15 and is axially as well as rotationally fixedly connected to the supporting body 9. In the body part 22 the piston 27 defines a compression or pumping chamber 30 in which a spring 29, such as a compression coil spring, is located. This engages the hollow piston 27 and is supported by a shoulder in the body part 22 so that it returns the piston unit 26 to its starting position after the pumping stroke. Adjoining the inner end of the body part 22 is a pliant or flexible riser 31 extending down to the bottom of the dispenser reservoir 19 in communicating the medium therefrom into the pumping chamber 30.

For controlling the flow of the medium or fluid, valves 32, 33, 34 and 38 are provided. The check or inlet valve 32 is located at the lower end of the pumping chamber 30 and comprises for closure thereof a non-spring-loaded, spherical closing element as well as a conical valve seat. The valve element closes by being moved in the direction 16. The outlet valve 33 is located within the piston unit 26 or piston 27 and opens either due to overpressure in the pumping chamber 30 or due to manual actuation, by one valve element being stopped in the stroke movement whilst the other valve element runs further on. The vent valve 34 is located at the outer circumference of the piston unit 26 or piston 27 and serves to equalize the pressure in the reservoir 19 by opening it to the atmosphere. For this purpose the valve 38 also serves, which as regards the air flowing into the reservoir 19 is located downstream of the valve 34 at the outer circumference of the body part 22 in preventing medium gaining access from the reservoir 19 through vent ports in the shell of the body part 22 into the body 21 or up to the valve 34. The valve 38 too, is configured as a check valve which opens on a vacuum in the reservoir 19 and automatically recloses once the pressure has been equalized.

The piston unit 26 is penetrated by an outlet passage 35 which valvelessly connects the pumping chamber 30 to the delivery orifice. The piston shank 28 comprises a piston or shank core 36 penetrating the sleeve-shaped piston 27, at the one end of which the spring 29 is supported and which is axially rigidly connected to a further shank part 37 elongating the core. The shank parts 36, 37 define in common the corresponding longitudinal section of the outlet passage 35 and locate an upper neck of the piston 27 so that the piston 27 is able to implement axial movements relative to the shank 28. The inner circumference of the piston 27 forms the valve element of the valve 33 which is included in the movement to the valve opening relative to the shank 28 in the direction 15 and is then returned to the closed position by the flexible piston neck. The valve seat is formed by a plate-shaped protuberance of the shaft core 36.

Between the outer circumference of the shank 28 and the inner circumference of the cover 23 the exchange air for the reservoir 19 is able to flow up to the valve 34 outside of the pumping chamber 30. The movable valve element of the latter is formed by the outer circumference of the piston 27, whilst the valve seat is formed by a protuberance of the cover 23 protruding in the direction 16 beyond the flange and seal 25 into the body part 22. In the starting position the valve 34 is closed by the spring 29 and on commencement of the pumping stroke is opened until returned to the starting position. The valve element of the valve 38 is formed by a cuff freely protruding in the direction 16 or parallel to the axis 10, this cuff surrounding the body part 22 or the vent ports passing through the shell and located radially adjoining the valve seat of the valve 34 whilst being integrally configured with the flat ring-shaped seal 25. In the vent paths, upstream of the reservoir space a germ filter or germicide may be provided which are also of advantage in the outlet passage 35 or in the region of the discharge nozzle. The valve 38 opens due to dilation of the valve cuff. The shank 28 comprises at the shank part 37 a connecting member, e.g. a plug-in connector 39, freeely protruding in the direction 15 for connecting a guide body 41.

The guide body 41 forms a pliant or „live" connection 40 between the connecting body 2 and the head body 3. The connecting body 2 thus comprises the supporting body 9, the piston shank 28 and a dimensionally rigid body section 42 of the guide body 41. This body section 42 is connected to the basic bodies 2, 3 axially located in forming the one end of the guide body 41. Its other end is likewise formed by a dimensionally rigid body section 43 and connected to all components of the head body 3 axially located. The flange or body section 42 is thus seccured to the supporting body 9 by it being plugged into the supporting body 9 in the direction 15 until stopped by a collar having an interference fit. Protruding from the inner side of the face wall of the cap-shaped body section 42 in the direction of the arrow 16 is a sleeve-shaped shaft section 44 in which the plug-in member 39 is secured by it being plugged in the direction 15 until stopped by shoulders. Protruding beyond the outer side of the face wall 45 is a likewise dimensionally rigid protuberance 46 which, as shown in FIG. 2, is located in the axial plane 13 and elongated in cross-section along the axis 12. The spacing of the axis 12 from the face wall 45 is maximally 1.5 times the length of the cross-section of the protuberance 46.

The body sections 42, 43 are interconnected exclusively via the pliant or elastomeric cavity or passage section 47 which integrally defines a cavity 48 forming a longitudinal section of the outlet passage 35. This passage also centrally passes through the body sections 42, 43. As evident from FIG. 3 the passage 48 has circular cross-sections, its passage wall differing in thickness circumferentially. In the axial plane 13 the passage wall is thickened e.g. by ribs protruding radially outwards on both sides, the protuberance 46 also featuring such ribs.

The end of the protuberance 46 remote from the face wall 45 translates into a flange plate protruding transversely to the plane 13. Protruding from the flange plate on both sides of the passage section 47 and the axial plane 14 are protuberances, such as cheeks 49, in the direction 15 so that they are set back relative to the body section 43. Provided at the outer sides of the cheeks 49 are mounting members, e.g. lugs 51 freely protruding in the axis 12 which are spring snapped into place in mounting openings of mounting shells 52 of the head body 3. The opposite members or mounting shells 52 are provided at the inner circumference of the head housing 4 or shell 6 radially spaced away on both sides of the core shank 5. All parts 42 to 49, 51 of the guide body 41 as described are configured integrally with each other.

Due to the connection 40 or passage section 47 and the joint 50 the head body 3 can be pivoted about the sole axis 12 relative to the connecting body 2 with sufficient friction to be reliably fixedly located in each intermediate position by friction. However, a spring latching means is just as conceivable to automatically locate each desired position and which can be defeated by increasing the pivoting force. Depending on the desired elastomeric response, the stiffening ribs as shown in FIG. 3 may also be hollow and form portions of the passage 48. Furthermore, the configuration may also be provided so that the axis 11 in the starting position is not located coaxially to but spaced away from the axis 10 axially parallel.

The hollow core shank 5 is fixedly held in place by an interference fit in the inner shell 7 as well as the nozzle 8 and like the inner shell 7 is radially spaced away from the outer shell 6. The distal end of the core shank 5 is formed by an inner and outer dilated section in which the body section 43 is fixedly seated by interference and is stopped by an annular collar at the end of this body section 43. Over the majority of its length the core shank 5 fully defines the outlet passage 35 which, however, emerges at the proximal end radially from the core shank 5 and is thus also defined by the inner surface areas of the nozzle 8. The proximal end surface area of the core shank 5 forms with the end wall of the nozzle 8 a means of diffusing or swirling the medium which then emerges atomized from the nozzle or delivery orifice 53. Outside of the inner shell 7 the core shank 5 is located totally free of contact and extends practically up to the joint axis 12.

The supporting body 9 is sleeve-shaped and surrounds, in the coaxial positionm corresponding to that as shown in FIG. 2, the distal end of the head body 3 over more than a third of its length. In the distal end of the supporting body 9 which is circumferentially closed, the body section 42 is inserted in an interference fit and stopped by an annular collar at the distal end surface area. The width of the body section 42 is substantially larger than that of the body section 43, however, the body sections 43, 44 may also be configured the same to the extent that each can be arranged optionally downstream or upstream.

In adjoining the closed sleeve section the shell of the supporting body 9 comprises an opening 54 extending up to its proximal end, the width of which is a snug fit on the outer circumference of the outer shell 6 and whose flat side flanks oriented parallel to each other have either clearance relative to the head body 3 or contact the head body 3 in the inclined locations with friction or radially flexible so that the latter is locked in any optional position. At the bottom of the U-shaped defined opening 54 the outer circumference of the outer shell 6 is stopped in the inclined position as shown in FIG. 1. The inner circumference of the distal end of the shell 6 may also be stopped by the protuberance 46, however. The shank part 37 may also be configured integrally with the guide body 41 and protrude permanently into the body 21.

The proximal end surface area of the supporting body 9 forms a finger rest 55 for finger contact by the user to actuate the discharge head in the direction 16 relative to the basic unit 18 in thus constricting the pumping chamber 30 in overcoming the force of the spring 29. The opposite finger rest is formed either by the outer circumference of the reservoir 19 or by the end surface area of the latter facing asway from the finger rest 55 so that discharge can be actuated single-handedly by the user. As indicated dot-dashed the finger rest 55 may also be dished for enhanced lateral guidance of the finger. In addition, in the radial elongation of the finger rest 55 at the outer circumference of the shell 6 a finger-tip abutment surface 56 may be provided and configured as a finger scallop, thus making it possible to simultaneously lock the head body 3 in its inclined end position by the actuating finger.

The shells 6, 7 as well as the complete nozzle 8 including its end wall are integral with each other. Likewise, the supporting body 9 is integral and could also be configured integrally with the guide body 41. The core shank 5 is likewise configured integrally throughout as well as integrally with the guide body 41, where necessary. Between the shaft section 44 and the outer shell the body section 42 may form a gap or annular groove into which the proximal end of the body 21 and of the cover 23 dives at the end of the stroke in the direction 16 or already in the starting position, resulting in a very short compact design.

For shipment or other purposes the head body 3 is oriented coaxially to the basic unit 18, resulting in the finger rest 55 being practically non-actuatable, due to the head body 3 or some other protuberance penetrating the plane of the finger rest 55 at right angles to the axis 10.

For discharging a single dose of the medium one finger, e.g. the index finger, is pressed against the abutment surface 56 to thus pivot the head body 3 until the finger also contacts the finger rest 55 in enabling the pumping stroke to be actuated. Towards the end thereof the valve 33 opens with the valve 32 closed so that the medium flows through the interior of the piston shank 28 and furthermore through the passage section 47 into the swirler as well as then from the nozzle parallel to the axis 11 into the atmosphere. The delivery orifice 53 could also be located in the shell of the nozzle 8 or radially or inclined to the axis 11, however. At the end of the pumping stroke the valve 33 closes automatically.

When, then, the finger rest 55, 56 is released, the bodies 3, 9 return solely by the force of the spring 29 to their starting position, whereby the valve 32 opens and medium is primed from the reservoir 19 into the pumping chamber 30. The spring 29 then, in the starting position, also maintains the valves 33, 34 tightly closed. The cited finger is simultaneously able to return the head body 3 to its coaxial starting position. Since relative to the abutment surface 56 or the nozzle 8 the finger rest 55 is pivotable between an actuating position and a position defeating actuation, this also ensures safeguarding against unintentional actuation.

Due to the elastomeric response of the passage section 47 no separate seals or sliding seals are necessary for the pliant connection.

As shown in FIG. 1 the basic unit 18 or the barrel of the reservoir 19 is wider than the discharge head in the coaxial position and as shown in FIG. 4 this width of the discharge head is maximally as large as that of the unit 18. This enables the dispenser 1 to be configured in size and shape like a pen to thus enable it to be carried in a garment pocket as conveniently as a ball-pen. The cylindrical reservoir 19 of glass, or the like, comprises spaced away from the neck or fastener 24 and down to its bottom at the outer circumference an extension which may be configured integrally with the reservoir 19 or formed by a separate sleeve having an integral bottom. It is into this that the reservoir 19 is then inserted in the direction 16 until stopped by the reservoir bottom at the bottom of the sleeve where it is securely located by an interference fit.

The proximal end surface area 58 of the extension or sleeve 57 serves to stop a cover 59 which, like an elongated pen cap, can be mounted in the direction 16 on the discharge head, fastener 24 and reservoir 19 until it comes up against the end surface area 58 by its open end surface area. For secure mounting, the fastener 24 is able to engage the inner circumference of the cover 59 by friction or by a spring latch member. The outer cross-sections of the sleeve 57 and cover 59 are the same, fill-length.

At the open end of the cover 59 a protruding collar may be provided for stopping the end surface area 58. Also the outer cross-sections of the reservoir barrel, fastener 24 or supporting body 9 or body section 42 may all be the same in this sense in contacting the inner circumference of the cover 59 by friction or with zero clearance. This is why, in the inclined position as shown in FIG. 5, the cover 59 can be mounted on the head body 3 and then—including the head body 3—pivoted into the coaxial position in thus not necessitating no direct contact of the head body 3 or the portion surrounding the delivery orifice 53 and accordingly enhancing sterile keeping. At the outer circumference of the cover 59 a spring pocket clip may be provided in enabling the closed dispenser 1 to be clip-pocketed like a pen.

It is understood that all features of any one embodiment may be provided in any other embodiment and that the cited features and effects may be provided precisely or merely substantially as described and may deviate therefrom depending on individual requirements.

What is claimed is:

1. A media dispenser comprising a pump and first and second basic bodies (2,3) including a head body (3) and a connecting body (2) connecting the head body to the pump, the head body including a moveable joint (50) between said first and said second basic bodies (2,3) and including a passage (48) traversing at least partly said basic bodies (2,3), wherein movements of said second basic body (3) relative to said first basic body (2) change the shape of a section of said passage (48) in the region of said joint (50), and wherein said passage (48) is provided in a guide body (41) which has in the region of said joint (50) a pliant passage section (47).

2. The dispenser as set forth in claim 1, wherein said guide body (41) comprising at least one dimensionally rigid body section (42,43) directly adjoining said passage section (47).

3. The dispenser as set forth in claim 2, wherein said passage (48) being configured integrally with at least one of said body sections (42,43).

4. The dispenser as set forth in claim 3, wherein at least one of said body sections (42, 43) totally surrounding said passage (48) circumferentially.

5. A media dispenser comprising a pump and first and second basic bodies (2,3) including a head body (3) and a connecting body (2) connecting the head body to the pump, the head body including a moveable joint (50) between said first and said second basic bodies (2,3) and including a passage (48) traversing at least partly said basic bodies (2,3), wherein movements of said second basic body (3) relative to said first basic body (2) change the shape of a section of said passage (48) in the region of said joint (50), and wherein said joint (50) comprises two pivotable interengaging joint members, namely a mounting opening and a mounting lug, said joint members (51, 52) being located laterally alongside said pliable passage section (47) being located spaced away from and between the two cheeks (49).

6. The dispenser as set forth in claim 5, wherein at least one of said joint members (51) of said joint (50) is provided at a cheek (49) located laterally spaced away from a wall of said passage (48), said cheek (49) freely protruding transversely to a joint axis (12) and said passage section (47) being located spaced away from and between the two cheeks (49).

7. A media dispenser comprising a pump and first and second basic bodies (2,3) including a head body (3) and a connecting body (2) connecting the head body to the pump, the head body including a moveable joint (50) between said first and said second basic bodies (2,3) and including a passage (48) traversing at least partly said basic bodies (2,3), wherein movements of said second basic body (3) relative to said first basic body (2) change the shape of a section of said passage (48) in the region of said joint (50), wherein the connecting body has a longitudinal centerline (10, 11) and the joint has an axis (12), which is located transversely to the longitudinal centerline (10,11), and wherein said joint (50) is covered by at least one wall (6), said wall being a shell (6) penetrated by said joint axis (12), the shell being integrally configured with said head body (3).

8. A media dispenser comprising a pump and first and second basic bodies (2,3) including a head body (3) and a connecting body (2) connecting the head body to the pump, the head body including a moveable joint (50) between said first and said second basic bodies (2,3) and including a passage (48) traversing at least partly said basic bodies (2,3), wherein movements of said second basic body (3) relative to said first basic body (2) change the shape of a section of said passage (48) in the region of said joint (50), and wherein a finger rest (55) is provided for actuating said dispenser (1) defining a finger rest plane, said plane being penetrated by said head obody (3), the location of which can be altered relative to said plane, and wherein said head body (3) permitting due to a pliant connection (40), a change in location between a rest position, in which said head body (3) penetrates said finger rest (55) roughly centrally, and an operating position, in which the head body (3) is inclined to said head body (3).

* * * * *

UNITED STATES PATENT AND TRADEMARK OFFICE

CERTIFICATE OF CORRECTION

PATENT NO. : 6,736,293 B2
DATED : May 18, 2004
INVENTOR(S) : Jurgen Greiner-Perth It is certified that error appears in the above-identified patent and that said Letters Patent is hereby corrected as shown below:

Column 2,
Line 28, “TIE” should be -- THE --.
Line 31, “detained” should be -- detailled --.

Column 7,
Line 27, “fill-length” should be -- full-length --.

Signed and Sealed this

Twelfth Day of October, 2004

JON W. DUDAS
*Director of the United States Patent and Trademark Office*